United States Patent [19]

Caggiano

[11] 4,433,822

[45] Feb. 28, 1984

[54] PAINT CAN RECEPTACLE AND THE LIKE

[76] Inventor: Nurmi Caggiano, 52 Wagon Wheel Ct., Pulaski, Pa. 16143

[21] Appl. No.: 293,995

[22] Filed: Aug. 18, 1981

[51] Int. Cl.[3] ..... E06C 7/14

[52] U.S. Cl. ..... 248/210

[58] Field of Search ..... 248/210, 211, 310, 311.2

[56] References Cited

U.S. PATENT DOCUMENTS

| | | | |
|---|---|---|---|
| 2,681,785 | 6/1954 | Jenny | 248/311.2 X |
| 2,686,032 | 8/1954 | Thorson | 248/211 |
| 2,735,641 | 2/1956 | Joecks | 248/210 |
| 2,880,953 | 4/1959 | Dicks | 248/311.2 |
| 3,313,506 | 4/1967 | Bauchard | 248/210 |
| 3,448,956 | 6/1969 | Kuhaneck | 248/311.2 X |

*Primary Examiner*—William H. Schultz

*Attorney, Agent, or Firm*—Eugene M. Bond

[57] ABSTRACT

The invention disclosed provides a paint can receptacle having a circular strip horizontally disposed to receive a paint can. A J-shaped ladder grip projects tangentially from the circular strip for rail engagement by the leg portion thereof. A first pivotal pin is positioned in the vicinity of the tangential union of the J-shaped ladder grip and the circular strip and joins a downwardly projecting vertical support member to the circular strip. A second pivotal pin is positioned diametrically opposite the first pivotal pin and joins the circular strip with a vertically disposed ladder rung gripping member intermediately therealong. The ladder rung gripping member has an arcuate terminal upper edge for rung engagement. A base support member is secured between the lower edge of the ladder rung gripping member and the lower edge of the downwardly projecting verticle support member thereby providing a support surface for the bottom of a paint can. Attached to the lower edge of the ladder rung gripping member is a downwardly disposed support member having an arcuate ladder rung brace configurated as the terminal edge thereof.

6 Claims, 5 Drawing Figures

PAINT CAN RECEPTACLE AND THE LIKE

BACKGROUND OF THE INVENTION

1. Field of the Invention

A paint can receptacle is provided for removable attachment to either side of a ladder while providing ready access for painting and movement along the ladder for change of painting locations.

2. Description of the Prior Art

Where ladders are used in painting buildings and the like, it is continually necessary to move the ladders to new positions as the work progresses. To avoid spillage of the paint, it is highly desirable that the paint bucket be firmly supported on the ladder in a simple yet readily removable manner. Devices have been employed which must be secured to the ladder in a permanent or semi-permanent fashion, but it will be apparent that these devices entail considerable inconvenience where the painter must move to new vertical locations on the ladder. Devices of a detachable nature have also been employed, but they have not afforded the security of retention essential for general jobbing.

In order to overcome these problems the various ladders have been devised wherein a platform is provided for the specific purpose of providing space on which to position a can of paint or other objects. The conventional step ladder is a well known example of this type of ladder. However, the step ladder with its shelf attached is inefficient in many applications due to its lack of versatility. The shelf or platform on this type of ladder is generally located in a single position and may not be positioned at various heights along the ladder.

In an attempt to overcome this lack of versatility many devices have been developed in the prior art for removably positioning a container at various levels along the length of a ladder. Such devices generally take the form of brackets or the like wherein the bracket itself is removably attached to the rung or other convenient portion of the ladder. The devices of this type are represented in the following U.S. Pat. Nos. 2,508,258 to Heinrich; 2,912,204 to Raysinger; 3,239,180 to Bachmann and 3,332,653 to Hoetzel.

Additional attempts in the prior art to resolve problems dealing with paint can receptacles include by way of example, U.S. Pat. Nos. 2,444,986 to Gebhardt; 2,686,032 to Thorson; 3,809,351 to Bravo; 4,013,251 to Cleveland; and 4,036,463 to Hopkins.

Devices of the type disclosed in these patents as well as other devices in the prior art, while attempting to overcome problems existing in the paint industry, generally include these advantages which often times makes these prior art structures undesirable. This type of structure often times suffers from being unduly complicated and structurally complex. This of course adds to the initial purchase price of the device and often times effects its operable life. In addition the cost of repair or replacement of these devices also makes them undesirable. The nature of this device in locating a paint container of a desired level along the ladder demand that it be readily removable from a given location and relocated at a different level on the same ladder. This is normally accomplished while the user of the device is positioned on the ladder himself. Prior art structures, again because of their overly complex structure, frequently make removal and attachment of the bracket overly difficult. This results in lost time, danger to the painter attempting to relocate the holding device and general inconvenience.

It can be seen that there is a great need in the paint industry for a holding device or bracket-type structure which can be efficiently and quickly connected to a desired point on a ladder and maintain a container or like structure connected to the ladder at a predetermined location.

Accordingly, an object of the present invention is to provide a paint bucket support of simple construction, that can be easily attached to cnventional ladders.

Another object of the invention is to provide a support that will securely hold the bucket both while painting and while moving the ladder, yet permitting its ready removal from the support when desired.

A feature of the invention resides in the fact that the support can be readily fabricated from ordinary sheet metal stock, or plastic.

Another feature of the invention resides in the use of hook means engaging both a rung and a side frame member of the ladder, such hook means being so designed that the bucket will be firmly supported in an upright manner.

Still another feature of the present invention lies in the employment of means for engaging either the sides of the bucket or its rim, thereby assuring retention of the bucket when the ladder is tilted into various positions.

The above objects, and other objects of my invention will be made more apparent hereinafter, are obtained by structure subsequently to be described and shown in the accompanying drawing.

SUMMARY OF THE INVENTION

Generally stated, the present invention provides a paint can receptacle which includes a circular strip horizontally disposed to a J-shaped ladder grip projecting tangentially from the circular strip for rail engagement by the leg portion thereof. A first pivotal pin is positioned in the vicinity of the tangential union of the J-shaped ladder grip and the circular strip, with the pivotal pin joining a downwardly projecting verticle support member. A second pivotal pin is positioned diametrically opposite the first pivotal pin, positioned for joining the circular strip with a vertically disposed ladder rung gripping member having an arcuately configurated run grip terminally disposed thereto and joining a base support member along the opposite end thereof. The second pivotal pin is joined intermediately along the vertically disposed ladder rung gripping member with the base support member supported by the downwardly projecting verticle support member and the vertically disposed ladder rung gripping member. A downwardly disposed support member having an arcuate ladder rung brace is positioned as a terminal edge thereof of the rung gripping member and is secured to a lower portion of the vertically disposed ladder rung gripping member.

In an embodiment paint can receptacle, there is disposed intermediately an adjustable wing bolt and screw securing an L-shaped ladder rail grip to the J-shaped ladder grip for locking engagement of the ladder rail by means of the leg portion of the J-shaped ladder grip, and one leg of the L-shaped ladder rail grip.

In another embodiment, the paint can receptacle has a horizontal support member which outwardly projects the vertical support member from the outer surface of the circular strip.

In yet another embodiment, the paint can receptacle includes a pivotal circular strip for movement 180 degrees about the first pivotal pin and the second pivotal pin.

The paint can receptacle may have the circular strip and the J-shaped ladder grip construction integrally. Also, the paint can receptacle may have the downwardly projecting vertical support member, the base support member, and the vertically disposed ladder run gripping member with arcuately configurated rung grip constructed integrally.

DETAILED DESCRIPTION OF THE INVENTION

Figure 1:
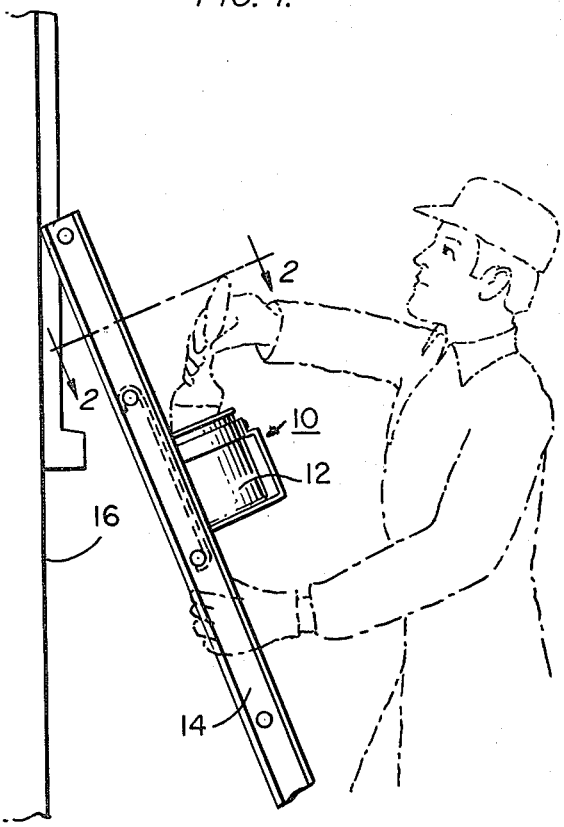
FIG. 1 illustrates the receptacle for a paint can displayed in association with a ladder when painting is being performed.

In the drawing wherein similar numerals represent similar elements throughout the several views, FIG. 1 illustrates receptacle 10 for paint can 12 mounted on metallic ladder 14 against surface 16 being painted by a painter illustrated in phantom.

When viewed in the direction of sectional lines 2—2, receptacle 10 includes circular strip 18, J-shaped ladder grip 20 contiguous therewith along with leg portion 22 projecting tangentially and serving as a means to secure the receptacle along rail 24 of the I-beam portion of metallic ladder 14.

Figure 3:
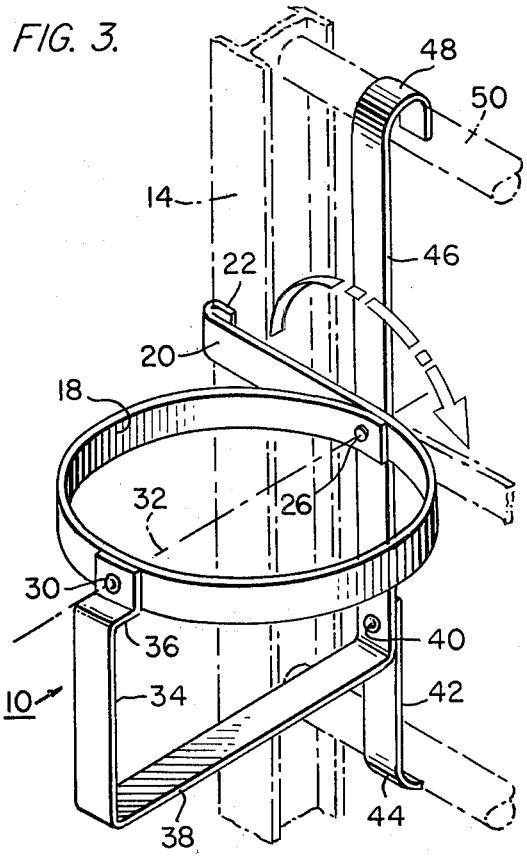
FIG. 3 is a perspective view of the present receptacle in association with a metal ladder illustrated in phantom.
Figure 2:
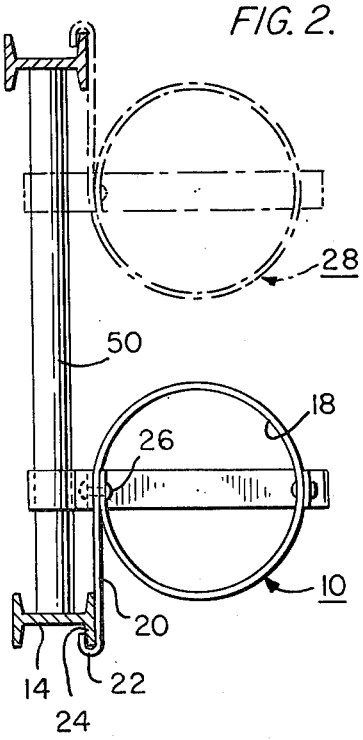
FIG. 2 is a top view of the receptacle for a paint can taken along sectional lines 2–2 of FIG. 1.

Because the J-shaped ladder grip 20 pivots about first pivotal pin 26 and second pivotal pin 30 both disposed along opposite portions of circular strip 14, receptacle 10 may be mounted along the left portion of a ladder, or alternatively by pivoting the J-shaped member 180 degrees along axis 32, FIG. 3, mounting may be effected along the right side of the ladder, phantom view 28, FIG. 2.

FIG. 3 illustrates receptacle 10 in greater detail, with J-shaped grip 20 secured to I-beam portion of metallic ladder 14 by means of leg portion 22. Pin 30 joins vertical support member 34 to circular strip 18. Conveniently, to provide easy access for a standard size paint can, vertical support member 34 may include horizontal support member 36 projecting vertical support member 34 away from the outer surface of circular strip 18. Vertical support member 34 joins base support member 38 and is preferably, although not necessarily, integral with vertical ladder rung gripping member 46 having arcuate rung grip 48 for engagement with rung 50.

In order to provide firm support for receptacle 10, downwardly disposed support member 42 is secured to vertical ladder rung support member 46 along a lower portion thereof by means of rivet 40. Arcuate ladder rung brace 44 formed integral as the terminal edge thereof, contacts a rung of the ladder as a lower supportive member.

Figure 4:
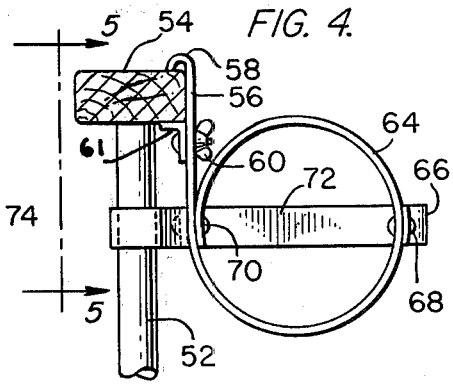
FIG. 4 is a top view of an embodiment receptacle of the present invention illustrated in position on a wooden ladder.
Figure 5:
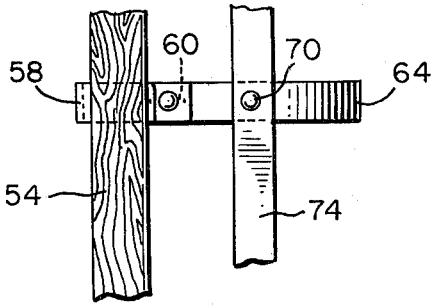
FIG. 5 is a sectional view taken along lines 5—5 of FIG. 4.

FIGS. 4 and 5 illustrate an embodiment paint can receptacle except in combination with a wooden style ladder having wooden rail 54 joining rung 52. J-shaped ladder grip 56 having U-shaped leg 58 is held securely to wooden rail 54 of the wooden ladder by means of wing bolt and screw 60 for clamping engagement with L-shaped ladder rail grip 61 which freely moves to any convenient disengagement and engagement positions which serves as a ladder clamp along with U-shaped ladder grip.

Operation of the embodiment receptacle is similar to that of receptacle 10, namely J-shaped member 56 pivots circular strip 64 about pin 70 and oppositely disposed pin 68 for usage along the left side of a ladder, the right side being illustrated in FIG. 5.

Vertical support member 66 is secured by pin 68 and joins base support member 72, all other members being similarly configurated to the elements of receptacle 10.

With respect to construction of the various elements of the present paint can receptacle, it will be recognized that the various elements may be economically molded or extruded from organic resinous materials such as polyethylene, polypropylene, nylon, and the like. The present paint can receptacle may also be constructed of most any convenient metal as desired. In order to reduce friction and to facilitate manipulation, certain of the working parts may be formed of metal or lubricant containing plastic materials as desired.

Although specific embodiments of the present invention have been described herein, it is to be understood that the foregoing detailed description is given merely by way of illustration and that many variations may be made therein without departing from the spirit of this invention.

What is claimed is:

1. A paint can receptacle which comprises, a circular strip horizontally disposed, a J-shaped ladder grip projecting tangentially from said circular strip, for rail engagement by the leg portion thereof, a first pivotal pin positioned in the vicinity of the tangential union of the J-shaped ladder grip and the circular strip, said pivotal pin joining the circular strip with a vertically disposed ladder rung gripping member having an arcuately configurated rung grip terminally disposed thereto and joining a base support member along the opposite end thereof, said pivotal pin being joined intermediately along the vertically disposed ladder rung gripping member, a second pivotal pin positioned diametrically opposite said first pivotal pin, said second pivotal pin joining a downwardly projecting vertical support member said base support member being supported by said downwardly projecting vertical support member and the vertically disposed ladder rung gripping member, and a downwardly disposed support member having an arcuate ladder rung brace positioned as a terminal edge thereof and secured to a lower portion of the vertically disposed ladder rung gripping member.

2. The paint can receptacle of claim 1 having an intermediately disposed adjustable wing bolt and screw securing an L-shaped ladder rail grip to the J-shaped ladder grip for locking engagement of the ladder rail by means of the leg portion of the J-shaped ladder grip, and one leg of the L-shaped ladder rail grip.

3. The paint can receptacle of claim 1 wherein a horizontal support member outwardly projects the vertical support member from the outer surface of the circular strip.

4. The paint can receptacle of claim 1 wherein the circular strip pivots 180 degrees about the first pivotal pin and the second pivotal pin.

5. The paint can receptacle of claim 1 wherein the circular strip and the J-shaped ladder grip are constructed integrally.

6. The paint can receptacle of claim 1 wherein the downwardly projecting vertical support member, the base support member, and the vertically disposed ladder rung gripping member with arcuately configurated rung grip are constructed integrally.

* * * * *